US009359938B2

(12) United States Patent
Schall et al.

(10) Patent No.: US 9,359,938 B2
(45) Date of Patent: Jun. 7, 2016

(54) TURBOCHARGER AND A COMPONENT THEREFOR

(71) Applicant: BorgWarner Inc., Auburn Hills, MI (US)

(72) Inventors: Gerald Schall, Bobenheim-Roxheim (DE); Ingo Dietrich, Gruenstadt (DE); Melanie Gabel, Bad Duerkheim (DE); Munevera Kulin, Kirchheimbolanden (DE)

(73) Assignee: BorgWarner Inc., Auburn Hills, MI (US)

( * ) Notice: Subject to any disclaimer, the term of this patent is extended or adjusted under 35 U.S.C. 154(b) by 92 days.

(21) Appl. No.: 14/350,476

(22) PCT Filed: Oct. 15, 2012

(86) PCT No.: PCT/US2012/060179

§ 371 (c)(1),
(2) Date: Apr. 8, 2014

(87) PCT Pub. No.: WO2013/059104

PCT Pub. Date: Apr. 25, 2013

(65) Prior Publication Data

US 2014/0255245 A1 Sep. 11, 2014

(30) Foreign Application Priority Data

Oct. 20, 2011 (DE) ..... 10 2011 116 621

(51) Int. Cl.

| | |
|---|---|
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/22*** | (2006.01) |
| ***C22C 38/24*** | (2006.01) |

(Continued)

(52) U.S. Cl.

CPC ..... *F02B 37/00* (2013.01); *C22C 38/02* (2013.01); *C22C 38/04* (2013.01); *C22C 38/22* (2013.01); *C22C 38/44* (2013.01); *C22C 38/46* (2013.01); *C22C 38/48* (2013.01); *F01D 5/28* (2013.01); *F02B 37/183* (2013.01); *F02B 37/24* (2013.01); *F05D 2220/40* (2013.01); *F05D 2300/17* (2013.01); *F05D 2300/5021* (2013.01)

(58) Field of Classification Search

CPC ..... C22C 38/02; C22C 38/04; C22C 38/08; C22C 38/12; C22C 38/22; C22C 38/24; C22C 38/26; C22C 38/34; C22C 38/40; C22C 38/44; C22C 38/46; C22C 38/48; F02B 37/00; F02B 39/00; F05D 2200/40; F05D 2300/17

USPC ..... 420/50, 51, 54; 75/236

See application file for complete search history.

(56) References Cited

U.S. PATENT DOCUMENTS

| | | | |
|---|---|---|---|
| 4,711,677 | A | 12/1987 | Mendelson |
| 4,921,025 | A | 5/1990 | Tipton et al. |

(Continued)

FOREIGN PATENT DOCUMENTS

| | | | |
|---|---|---|---|
| WO | 2010036533 | A2 | 4/2010 |

*Primary Examiner* — Helene Klemanski

(74) *Attorney, Agent, or Firm* — A. Michael Tucker; Stephan A. Pendorf; Patent Central LLC

(57) ABSTRACT

A component for turbocharger applications, in particular in diesel engines, made of an iron-based alloy having an austenitic base structure which has a carbide structure.

9 Claims, 1 Drawing Sheet

(51) Int. Cl.

| | |
|---|---|
| ***C22C 38/26*** | (2006.01) |
| ***C22C 38/34*** | (2006.01) |
| ***C22C 38/40*** | (2006.01) |
| ***C22C 38/44*** | (2006.01) |
| ***C22C 38/46*** | (2006.01) |
| ***C22C 38/48*** | (2006.01) |
| ***F02B 39/00*** | (2006.01) |
| ***F02B 37/00*** | (2006.01) |
| *F01D 5/28* | (2006.01) |
| *F02B 37/18* | (2006.01) |
| *F02B 37/24* | (2006.01) |

(56) References Cited

U.S. PATENT DOCUMENTS 6,383,310 B1 5/2002 Otsuka
6,852,143 B2 * 2/2005 Hayashi ..... C22C 38/34 75/240
2007/0086910 A1 * 4/2007 Liang ..... C22C 38/04 420/12
2007/0217941 A1 * 9/2007 Hayashi ..... C22C 38/02 420/38
2009/0269235 A1 * 10/2009 Fukae ..... C22C 38/40 419/11
2010/0054983 A1 * 3/2010 Osuki ..... C22C 38/40 420/54
2011/0171008 A1 * 7/2011 Schall ..... C22C 38/44 415/159
2011/0176912 A1 * 7/2011 Schall ..... F01D 17/165 415/148
2011/0176914 A1 * 7/2011 Schall ..... C22C 38/48 415/170.1
2011/0182749 A1 * 7/2011 Schall ..... C22C 38/46 416/241 R
2013/0058825 A1 * 3/2013 Fukae ..... C22C 38/40 75/236

* cited by examiner

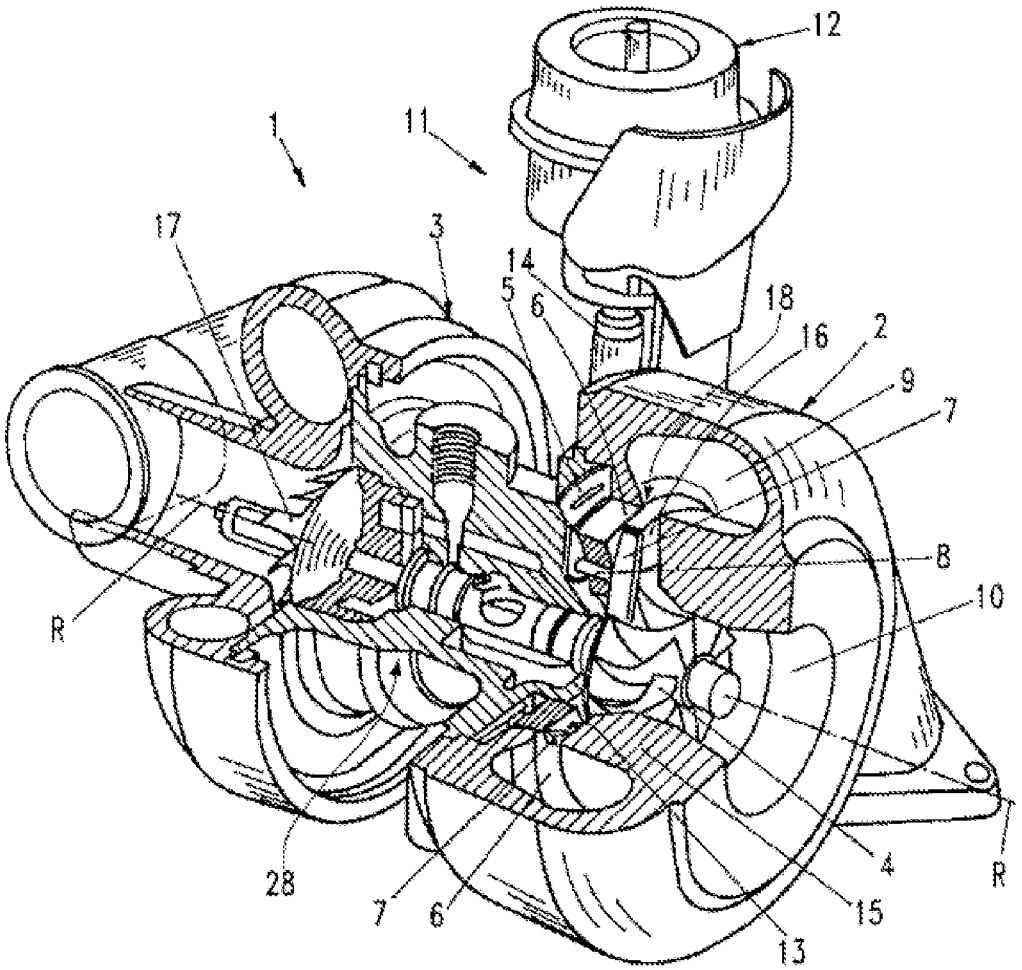
12
1
11
17
3
14
5
6
18
16
2
9
7
8
10
R
28
7
6
4
15
13
R

TURBOCHARGER AND A COMPONENT THEREFOR

The invention relates to a component for turbocharger applications, in particular in a diesel engine, and also to an exhaust-gas turbocharger.

Exhaust-gas turbochargers are systems intended to increase the power of piston engines. In an exhaust-gas turbocharger, the energy of the exhaust gases is used to increase the power. The increase in power is a result of the increase in the throughput of mixture per working stroke.

A turbocharger consists essentially of an exhaust-gas turbine with a shaft and a compressor, wherein the compressor arranged in the intake tract of the engine is connected to the shaft and the blade wheels located in the casing of the exhaust-gas turbine and the compressor rotate. In the case of a turbocharger having a variable turbine geometry, adjusting blades are additionally mounted rotatably in a blade bearing ring and are moved by means of an adjusting ring arranged in the turbine casing of the turbocharger.

Extremely high demands are made on the material of the components of a turbocharger, and in particular of the kinematics components or of the wastegate components thereof, or, in the case of a VTG turbocharger, also of the VTG components thereof. The material of these components has to be heat-resistant, i.e. it still has to afford sufficient strength and therefore dimensional stability even at very high temperatures of up to about 1000° C. or higher. Furthermore, the material has to have a high resistance to wear and also appropriate oxidation resistance, so that the corrosion or wear on the material is reduced even at the high operating temperatures of several hundred ° C., and therefore the resistance of the material remains ensured under the extreme operating conditions.

DE 10 2004 062 564 A1 discloses a blade bearing ring for a turbocharger having good thermal stability and low sliding wear. In this type of blade bearing ring, use is made of an austenitic material, an iron-based alloy which has a high sulfur content for improving the lubricating action of the component. Owing to the specific composition, the creep resistance of the material is increased and therefore an increased dimensional stability of the blade bearing ring is achieved at temperatures of above 850° C.

In view of this, it is an object of the present invention to provide a component for turbocharger applications and also a turbocharger, which have an improved temperature and oxidation resistance and therefore also a very good dimensional stability and high-temperature strength, and also creep strength, fracture strength and corrosion resistance, are distinguished by optimum tribological properties and additionally show a reduced susceptibility to wear, even at temperatures of up to 1020° C.

The object is achieved by a component for turbocharger applications, comprising an iron-based alloy having an austenitic base structure comprising a carbide structure, and an exhaust-gas turbocharger, comprising at least one component comprising an iron-based alloy having an austenitic base structure comprising a carbide structure.

An improved temperature resistance of the material and in particular improved sliding wear properties and a reduced tendency toward oxidation thereof are achieved by the embodiment according to the invention, in the form of a component for turbocharger applications or of an exhaust-gas turbocharger comprising such a component, consisting of an iron-based alloy having an austenitic base structure which comprises a specific carbide structure. In addition, the creep strength and also fracture strength of the material are increased. Within the context of the invention, a carbide structure is understood to mean in this case a microstructural carbide precipitation phase which is formed in the grain and at the grain boundaries of the austenitic iron-based alloy. The carbide structure is, in particular, a dendritic microstructure, as a result of which a very good resistance of the material and therefore of the component to deformation and wear is also achieved. Provision is therefore made of a component for turbocharger applications, or an exhaust-gas turbocharger which comprises at least one component according to the invention, which has an outstanding temperature resistance up to 1020° C., also has a high high-temperature strength, has a high wear, oxidation and corrosion resistance and is distinguished in addition by very good sliding properties with a very good creep strength and fracture strength, in particular at the high operating temperatures. The properties of the component for turbocharger applications or of the exhaust-gas turbocharger which are mentioned here are achieved throughout the service life of the component or of the turbocharger, even during continuous operation at temperatures of up to 1020° C.

Without being bound to theory, it is assumed that the presence of a carbide structure, i.e. carbide precipitations in the austenitic iron-based alloy, considerably increases the stability of the alloy material and therefore the stability of the component, in particular to friction wear, and also the high-temperature strength thereof on account of this unique structure.

By way of example, the iron-based alloy according to the invention, i.e. the austenitic iron-based material having a carbide structure which forms the component, and consequently the component according to the invention, is distinguished by a maximum sliding wear rate of 0.08 mm in diameter given a contact pressure of 20 MPa, a sliding speed of 0.0025 m/s, a component temperature of about 1020° C. and 2 000 000 cycles, i.e. by a very good resistance to friction wear. In addition, the high-temperature strength, the dimensional stability, the creep strength and the fracture strength and also the oxidation resistance and high-temperature performance of the iron-based alloy, and consequently of the component for turbocharger applications formed therefrom, are also improved.

The dependent claims relate to advantageous developments of the invention.

Thus, in one embodiment, the wear properties of the component, i.e. specifically the resistance thereof to friction wear, and also the high-temperature strength and corrosion resistance thereof, even at the high operating temperatures of up to 1020° C., can be improved considerably by the use of at least one of the elements tungsten (W), chromium (Cr) and niobium (Nb) in the austenitic iron-based alloy from which the component according to the invention is formed. In this case, the elements W, Cr and Nb substantially form the carbide structure that is essential to the invention in the austenitic iron-based alloy, which, in addition to the very good wear performance at high operating temperatures, also increases the oxidation resistance of the material at high temperatures and therefore of the component according to the invention.

In a further embodiment, the component according to the invention for turbocharger applications is distinguished by the fact that the iron-based alloy which forms the component comprises at least one of the elements selected from: C, Cr, W, Nb, Mn, V, Ni and Si. The presence of at least one of these elements is to be understood as meaning that such an element or a combination of these elements is used to produce the iron-based alloy, which is then processed to form the component according to the invention. The elements added to the iron-based alloy can be present here in their original form, i.e. in elemental form, for example in the form of inclusions or precipitation phases, or else in the form of derivatives thereof, i.e. in the form of a compound of the corresponding element, e.g. as a metal carbide or metal nitride, which form either during the production of the iron-based alloy or else when forming the component according to the invention which is produced therefrom. The presence of the elements can be detected directly in this case in the component according to the invention by conventional analytical methods.

The element carbon serves here primarily for forming the carbide structure that is essential to the invention, i.e. the carbidic precipitation phases, and therefore considerably improves the strength of the material and also the high-temperature strength thereof, and therefore of the component according to the invention for turbocharger applications. The use of chromium increases the high-temperature tensile strength and the scaling resistance of the material. Chromium is additionally a strong carbide former, and therefore the wear properties of the material, and therefore of the component according to the invention, are also optimized thereby. The use of the element chromium in the austenitic iron-based alloy from which the component according to the invention for turbocharger applications is formed has yet another advantage: in particular under the operating conditions of the component according to the invention, i.e. in particular under the action of the high exhaust-gas temperatures of up to 1020° C., chromium also forms a $Cr_2O_3$ surface layer on the surface of the component, i.e. an oxidic surface layer, which efficiently promotes the resistance of the iron-based alloy, and consequently of the component according to the invention, to sliding wear and friction wear under thermal loading. The element tungsten, too, is a strong carbide former and, in particular, as a result of the formation of carbide structures, increases the high-temperature strength and wear resistance of the material and contributes to increasing the toughness thereof. A combination of tungsten with chromium and, if appropriate, the further addition of molybdenum (Mo), in particular, makes it possible to considerably improve the corrosion resistance of the material in acid media, and also the hot corrosion performance. Like carbon, chromium and tungsten, niobium is also a carbide former and therefore promotes the carbide structure, that is essential to the invention, of the austenitic iron-based alloy in the grain and at the grain boundaries. In addition, it contributes to increasing the high-temperature strength and creep strength of the iron-based alloy, and consequently of the component for turbocharger applications which is formed therefrom. Niobium further promotes austenite formation and reduces the gamma region of the iron-based alloy according to the invention, and can therefore be used in regulatory fashion. The use of manganese has a deoxidizing effect. It expands the gamma region of the austenitic iron-based alloy and increases the yield strength and tensile strength of the material. In addition, manganese promotes the wear resistance of the component, in particular at high operating temperatures. Vanadium refines the primary grain of the iron-based alloy according to the invention during the production thereof and therefore refines the cast structure thereof. This achieves a high degree of grain refinement, which promotes the homogeneity of the iron-based alloy and permits a higher dynamic contact pressure of the material. Nickel stabilizes the austenitic structure and makes it possible to achieve the high temperature stability and also hot gas performance of the iron-based alloy. Furthermore, nickel stabilizes the face-centered cubic structure, such that a seamless solid solution formation can arise in the face-centered cubic phase. In addition, the high-temperature strength is also improved decisively above 600° C. by the addition of nickel. At the same time, the element nickel, in connection with chromium and molybdenum, improves the corrosion resistance in acid media. Silicon promotes the casting properties of the iron-based alloy by reducing the viscosity of the melt during casting. In addition, silicon in the material according to the invention promotes deoxidation, and therefore the addition of this element to the alloy decisively improves the resistance to hot corrosion. By suitably selecting and combining the elements, the properties of the iron-based alloy can therefore be controlled in a targeted manner, such that the component according to the invention for turbocharger applications and therefore also the exhaust-gas turbocharger according to the invention have a particularly balanced profile of properties. Further elements, and also compounds, can be introduced into the iron-based alloy.

According to a further embodiment, the component according to the invention for turbocharger applications is distinguished by the fact that it comprises substantially the elements carbon (C) with 0.1 to 0.5% by weight, in particular with 0.25 to 0.4% by weight, chromium (Cr) with 20 to 28% by weight, in particular with 24 to 26% by weight, manganese (Mn) with at most 1.3% by weight, in particular with at most 1% by weight, silicon (Si) with 0.5 to 1.8% by weight, in particular with 0.7 to 1.5% by weight, niobium (Nb) with 0.5 to 2.0% by weight, in particular with 0.8 to 1.5% by weight, tungsten (W) with 0.8 to 4.0% by weight, in particular with 1.0 to 3.5% by weight, vanadium (V) with 0 to 1.8% by weight, in particular with 0 to 1.5% by weight, nickel (Ni) with 20 to 28% by weight, in particular with 24 to 26% by weight, and iron (Fe) as the remainder. The indications of quantity in each case relate here to the overall weight of the iron-based alloy from which the component according to the invention is formed. As already stated, the presence of said elements is to be understood as meaning that they can be present both in elemental form and also in the form of one of the compounds thereof in the iron-based alloy, and therefore in the component according to the invention for turbocharger applications. In this embodiment, substantially the aforementioned elements are present in the component according to the invention in the quantities indicated. This means that unavoidable impurities may be present, although these preferably make up less than 2% by weight and in particular less than 1% by weight, based on the overall weight of the iron-based alloy. The unavoidable residues or impurities in this case encompass, for example, aluminum (Al), zirconium (Zr), cerium (Ce), boron (B), phosphorus (P) and sulfur (S). The quantities of the individual elements can in this case be detected directly in the component according to the invention by means of conventional elemental analysis methods.

It has surprisingly been found that precisely the described combination provides a material, i.e. an iron-based alloy, which, when it is processed to form a component for turbocharger applications, provides said component with a particularly balanced profile of properties. This composition according to the invention provides a component which has a particularly high high-temperature strength, a temperature resistance up to 1020° C. and therefore dimensional stability at a high temperature, and which is distinguished by outstanding sliding properties and therefore particularly low sliding wear. In addition, the creep strength and fracture strength, corrosion resistance and oxidation resistance are maximized, in particular at high operating temperatures, as act during operation of a turbocharger on the corresponding component.

A material which is produced in this way and from which the component according to the invention is formed thus has the following properties:

| Mechanical property | Value | Measurement process |
|---|---|---|
| Tensile strength $R_m$ | >650 MPa | ASTM E 8M/EN 10002-1; at elevated temp.: EN 10002-5 |
| Yield strength $R_{p\,0.2}$ | >290 MPa | Standard process |
| Elongation at break | >15% | Standard process |
| Hardness | 220-285 HB | ASTM E 92/ISO 6507-1 |
| Coefficient of linear expansion | 16.5-18.5 $K^{-1}$ (20 to 1020° C.) | Standard process |

According to a further embodiment of the invention, the component for turbocharger applications is substantially free of sigma phases. This applies in particular to the operation of the component according to the invention up to 1000° C. and even up to 1020° C. This effectively counteracts embrittlement of the material, as a result of which the durability of the component is increased. Sigma phases are brittle, intermetallic phases of high hardness. They arise when a body-centered cubic metal and a face-centered cubic metal, whose atomic radii match with only a slight discrepancy, strike one another. Sigma phases of this type are undesirable since they have an embrittling effect and also because of the property of the iron matrix to withdraw chromium. The iron-based alloy according to the invention and therefore also the component according to the invention are substantially free of sigma phases, such that the undesirable effects described here fail to appear. The reduction in or prevention of the formation of sigma phases is controlled, in particular, by a targeted selection of the elements of the iron-based alloy according to the invention, and in particular is achieved in that the silicon content in the alloy material is at most 1.8% by weight and preferably at most 1.5% by weight, based in each case on the overall weight of the iron-based alloy.

What is therefore described according to the invention is a component for turbocharger applications which is distinguished by an outstanding wear performance, i.e. a high sliding wear resistance even at high temperatures of up to 1020° C., a high high-temperature strength and also dimensional stability and furthermore by an excellent oxidation resistance, creep strength and fracture strength and corrosion resistance. By virtue of these outstanding properties, the component according to the invention is suitable in particular for those components for turbocharger applications which are exposed to high temperatures of up to 1020° C. and/or high levels of friction. Exemplary components comprise kinematics components, wastegate components and VTG components, and in particular VTG components and flap mount parts.

The austenitic iron-based alloy can be produced and processed to form the component according to the invention for turbocharger applications by means of conventional processes. To ensure dimensional stability, age-annealing can be carried out at 900° C. for about 2 hours, with subsequent air cooling, in order to generate secondary precipitations. The material can be welded by means of TIG, plasma and EB welding processes.

As an object which can be dealt with independently, claim 7 defines an exhaust-gas turbocharger comprising at least one component, as already described, which consists of an iron-based alloy having an austenitic base structure and comprises a carbide structure.

The advantageous embodiments of the component according to the invention are also applicable in the embodiments of the exhaust-gas turbocharger according to the invention.

FIG. 1 shows a perspective view, shown partially in section, of an exhaust-gas turbocharger according to the invention. FIG. 1 shows a turbocharger 1 according to the invention, which has a turbine casing 2 and a compressor casing 3 which is connected to the latter via a bearing casing 28. The casings 2, 3 and 28 are arranged along an axis of rotation R. The turbine casing is shown partially in section in order to illustrate the arrangement of a blade bearing ring 6 and a radially outer guide grate 18, which is formed by said ring and has a plurality of adjusting blades 7 which are distributed over the circumference and have rotary axles 8. In this way, nozzle cross sections are formed which, depending on the position of the adjusting blades 7, are larger or smaller and act to a greater or lesser extent upon the turbine rotor 4, positioned in the center on the axis of rotation R, with the exhaust gas from an engine, said exhaust gas being supplied via a supply duct 9 and discharged via a central connection piece 10, in order to drive a compressor rotor 17 seated on the same shaft using the turbine rotor 4.

In order to control the movement or the position of the adjusting blades 7, an actuating device 11 is provided. This may be designed in any desired way, but a preferred embodiment has a control casing 12 which controls the control movement of a tappet member 14 fastened to it, in order to convert the movement of said tappet member on an adjusting ring 5, located behind the blade bearing ring 6, into a slight rotational movement of the latter. A free space 13 for the adjusting blades 7 is formed between the blade bearing ring 6 and an annular part 15 of the turbine casing 2. So that this free space 13 can be ensured, the blade bearing ring 6 has spacers 16.

What is also described according to the invention is an iron-based alloy having an austenitic base structure which comprises a carbide structure and in particular comprises substantially the following elements:

C: 0.1 to 0.5% by weight, in particular 0.25 to 0.4% by weight,

Cr: 20 to 28% by weight, in particular 24 to 26% by weight,

Mn: ≤1.3% by weight, in particular ≤1% by weight,

Si: 0.5 to 1.8% by weight, in particular 0.7 to 1.5% by weight,

Nb: 0.5 to 2.0% by weight, in particular 0.8 to 1.5% by weight,

Ni: 20 to 28% by weight, in particular 24 to 26% by weight,

W: 0.8 to 4.0% by weight, in particular 1.0 to 3.5% by weight,

V: 0 to 1.8% by weight, in particular 0 to 1.5% by weight, and

Fe: ad 100% by weight.

Such an iron-based alloy is distinguished by a high high-temperature strength, good corrosion resistance, creep strength and fracture strength, and also oxidation resistance and a low wear rate even at high temperatures of about 1000° C. during continuous operation. Such an austenitic material is suitable particularly for components which are permanently exposed to high temperatures and high levels of friction, such as for example components for turbocharger applications, to which the present invention is not to be limited, however.

EXAMPLE

Unless specified otherwise, the indications of quantity of the individual elements relate in each case to the overall weight of the iron-based alloy.

An iron-based alloy from which a plurality of components according to the invention for turbocharger applications, specifically flap shaft, flap plate and bush, were formed was produced from the following elements by a common process. The chemical analysis yielded the following values for the elements: C: 0.25 to 0.4% by weight, Cr: 24 to 26% by weight, Mn: less than 1% by weight, Si: 0.7 to 1.5% by weight, Nb: 0.8 to 1.5% by weight, W: 1.0 to 3.5% by weight, V: 0 to 1.5% by weight, Ni: 24 to 26% by weight, and Fe as the remainder. In addition, unavoidable residues of Al, Zr, Ce, B, P and S were found in traces with a proportion of less than 1% by weight.

The components produced in accordance with this example were distinguished by the following properties:

| Property | Measured value (measurement process) |
|---|---|
| Tensile strength $R_m$ at 20° C. | 653 MPa (ASTM E 8M/EN 10002-1) |
| Yield strength $R_p$ 0.2 at 20° C. | 294 MPa (standard process) |
| Elongation at break | 15.5% (standard process) |
| Hardness | 263 HB (ASTM E 92/ISO 6507-1) |
| Coefficient of linear expansion at 20° C. | 16.5 $K^{-1}$ (standard process) |
| Coefficient of linear expansion at 950° C. | 18.9 $K^{-1}$ (standard process) |
| Coefficient of linear expansion at 1000° C. | 19.3 $K^{-1}$ (standard process) |
| Coefficient of linear expansion at 1025° C. | 19.6 $K^{-1}$ (standard process) |
| High-temperature strength $R_m$ at 900° C. | 212 MPa (EN 10002-5) |
| High-temperature strength $R_m$ at 800° C. | 273 MPa (EN 10002-5) |
| High-temperature strength $R_m$ at 700° C. | 373 MPa (EN 10002-5) |
| High-temperature strength $R_m$ at 600° C. | 399 MPa (EN 10002-5) |
| High-temperature strength $R_m$ at 500° C. | 450 MPa (EN 10002-5) |
| High-temperature strength $R_m$ at 400° C. | 510 MPa (EN 10002-5) |
| Yield strength $R_p$ 0.2 at 900° C. | 148 MPa (standard process) |
| Yield strength $R_p$ 0.2 at 800° C. | 163 MPa (standard process) |
| Yield strength $R_p$ 0.2 at 700° C. | 188 MPa (standard process) |
| Yield strength $R_p$ 0.2 at 600° C. | 200 MPa (standard process) |
| Yield strength $R_p$ 0.2 at 500° C. | 210 MPa (standard process) |
| Yield strength $R_p$ 0.2 at 400° C. | 231 MPa (standard process) |

The material was subjected to a validation test series which comprised the following tests:

Open-air weathering test
Climate change test
Thermal shock test/cycle test—300 h
Hot-gas corrosion test in a cracking furnace
Strauss test according to DIN EN ISO 3651-2
Vibration friction wear test on a tribometer: bush/shaft at operating temperature (1020° C.)

The respective component was distinguished in all tests by an outstanding resistance to the acting forces. The material therefore had an extremely high wear resistance and outstanding oxidation resistance (maximum rate of oxidation: 30 μm), such that corrosion and wear/friction wear to the material were reduced considerably under the indicated conditions, and therefore the resistance, and also creep strength and fracture strength, of the material and therefore also of the component formed therefrom also remained ensured over a long time.

Thermal cycle test:

The components (shaft/bush) according to the invention were subjected to a thermal cycle test, in which the thermal shocks were carried out as follows:

1. use of stationary rotors;
2. 2-EGT operation;
3. test duration: 350 h (approximately 2000 cycles);
4. throughout the test, the exhaust-gas flap of the EGTs remains open by 15°;
5. high temperature: rated power point T3=750° C., mass flow EGT on the turbine side: 0.5 kg/s;
6. low temperature: T3=100° C., mass flow EGT on the turbine side: 0.5 kg/s;
7. cycle duration: 2×5 min. (10 min.);
8. three intermediate crack tests are carried out.

Given the following load collective, the respective component (shaft/bush) according to the invention was distinguished by a low high-temperature oxidation, i.e. an oxidation rate of at most 40 μm, in particular of at most 30 μm, at a component temperature of 1020° C.:

| Parameter | Result |
|---|---|
| Bearing load | 10-18 $N/mm^2$ |
| Sliding speed | 0.0025 m/s |
| Component temperature | 700-1020° C. |
| Surface roughness | Rz 6.3 |
| Test medium | Otto exhaust gas |
| Test duration | 500 h |
| Clock frequency | 0.2 Hz |
| Adjustment angle | 45° |
| Friction value | <0.18 |
| Journal diameter | 4.7 mm |
| Pressure pulsation | >200 bar |
| Exhaust-gas pressure | 1.5 bar |
| Wear rate | <0.10 mm |

The results indicated here verify that the component according to the invention is ideally suited for turbocharger applications in a temperature range of up to 1020° C.

LIST OF REFERENCE SIGNS

1 Turbocharger
2 Turbine casing
3 Compressor casing
4 Turbine rotor
5 Adjusting ring
6 Blade bearing ring
7 Adjusting blades
8 axles
9 Supply duct
10 Axial connection piece
11 Actuating device
12 Control casing
13 Free space for guide blades 7
14 Tappet member
15 Annular part of the turbine casing 2
16 Spacer/spacer cam
17 Compressor rotor
18 Guide grate
28 Bearing casing
R Axis of rotation

The invention claimed is:

1. A component for turbocharger applications, based alloy having an austenitic base structure comprising a carbide structure, wherein the iron-based alloy consists essentially of the following elements;

C: 0.1 to 0.5% by weight,
Cr: 20 to 28% by weight,
Mn: ≤1.3% by weight,
Si: 0.5 to 1.8% by weight,
Nb: 0.5 to 2.0% by weight,
Ni: 20 to 28% by weight,
W: 0.8 to 4.0% by weight,
V: 0 to 1.8% by weight, and
Fe: ad 100% by weight, and
wherein the component has a maximum sliding wear rate of 0.08 mm in diameter given a contact pressure of 20 MPa, a sliding speed of 0.0025 m/s, a component temperature of about 1020° C. and 2.000.000 cycles.

2. The component for turbocharger applications as claimed in claim 1, wherein the iron-based alloy is substantially free of sigma phases.

3. The component for turbocharger applications as claimed in claim 1, wherein the component is a kinematics component, a wastegate component a VTG component.

4. The component for turbocharger applications as claimed in claim 1, wherein the component is a diesel engine turbocharger component.

5. The component for turbocharger applications as claimed in claim 1, wherein the iron-based alloy consists essentially of the following elements:

C: 0.25 to 0.4% by weight,
Cr: 24 to 26% by weight,
Mn: ≤1% by weight,
Si: 0.7 to 1.5% by weight,
Nb: 0.8 to 1.5% by weight,
Ni: 24 to 26% by weight,
W: 1.0 to 3.5% by weight,
V: 0 to 1.5% by weight, and
Fe: ad 100% by weight.

6. The component for turbocharger applications as claimed in claim 1, wherein the component is a VTG component or a flap mount part.

7. An exhaust-gas turbocharger, comprising at least one component comprising an iron-based alloy having an austenitic base structure comprising a carbide structure, wherein the alloy comprises substantially the following elements:

C: 0.1 to 0.5% by weight,
Cr: 20 to 28% by weight,
Mn: ≤1.3% by weight,
Si: 0.5 to 1.8% by weight,
Nb: 0.5 to 2.0% by weight,
Ni: 20 to 28% by weight,
W: 0.8 to 4.0% by weight,
V: 0 to 1.8% by weight, and
Fe: ad 100% by weight, and wherein the component has a maximum sliding wear rate of 0.08 mm in diameter given a contact pressure of 20 MPa, a sliding weed of 0.0025 m/s, a component temperature of about 1020° C. and 2,000,000 cycles.

8. The exhaust-gas turbocharger as claimed in claim 7, wherein the component is substantially free of sigma phases.

9. The exhaust-gas turbocharger as claimed in claim 7, wherein the component comprises substantially the following elements:

C: 0.25 to 0.4% by weight,
Cr: 24 to 26% by weight,
Mn: ≤1% by weight
Si: 0.7 to 1.5% by weight,
Nb: 0.8 to 1.5% by weight,
Ni: 24 to 26% by weight,
W: 0 1.0 to 3.5% by weight,
V: 0 to 1.5% by Weight, and
Fe: ad 100% by weight.

* * * * *